United States Patent [19]

Dellea

[11] 4,456,386

[45] Jun. 26, 1984

[54] TIMEPIECE HAVING A DIVIDER CHAIN WITH AN ADJUSTABLE DIVISION RATE

[75] Inventor: Mario Dellea, Les Geneveys-sur-Coffrane, Switzerland

[73] Assignee: Societe Suisse pour l'Industrie Horlogere Management Services S.A., Bienne, Switzerland

[21] Appl. No.: 324,497

[22] Filed: Nov. 24, 1981

[30] Foreign Application Priority Data

Nov. 26, 1980 [CH] Switzerland ..... 8742/80

[51] Int. Cl.[3] ..... G04B 17/12

[52] U.S. Cl. ..... 368/201; 368/202

[58] Field of Search ..... 331/176; 368/201, 200

[56] References Cited

U.S. PATENT DOCUMENTS 4,024,416 5/1977 Fujita et al. ..... 368/202
4,159,622 7/1979 Akahane ..... 331/176
4,325,036 4/1982 Kuwabara ..... 368/202
4,344,046 8/1982 Zumsteg ..... 331/176
4,345,221 8/1982 Zumsteg ..... 331/176

*Primary Examiner*—Bernard Roskoski
*Attorney, Agent, or Firm*—Griffin, Branigan & Butler

[57] ABSTRACT

The timepiece includes a low frequency oscillator serving as time base and arranged to feed a first chain of frequency dividers having an adjustable division rate in order to display the time and a high frequency oscillator feeding a second chain of frequency dividers. During an imprecise period established by the first chain (3) reference pulses from the second chain (7) are counted thereby to establish a binary value (HF−DF) representing the amount of imprecision of the first chain in respect of the reference. This value is transferred into a memory in order to correct directly or indirectly the division rate of the first divider chain. There is thus obtained an oscillator having the stability of a high frequency oscillator but with energy consumption only slightly exceeding that of a low frequency oscillator.

5 Claims, 5 Drawing Figures

TIMEPIECE HAVING A DIVIDER CHAIN WITH AN ADJUSTABLE DIVISION RATE

BACKGROUND OF THE INVENTION

The object of the invention comprises a timepiece including a low frequency oscillator acting as time base arranged and adapted to feed a first chain of frequency dividers having an adjustable division rate in order to display the time and a high frequency oscillator feeding a second chain of frequency dividers.

Such an arrangement is known from the European Patent Office publication No. 0 015 873 (corresponding U.S. Pat. No. 4,344,046). In this publication there is claimed a high frequency quartz oscillator which with the purpose of lowering the current consumption thereof includes a circuit equipped with a low frequency quartz oscillator, means for producing a correction signal which serves to control a programmable frequency divider and an electronic switch in order to periodically interrupt the high frequency quartz oscillator.

Effectively it is known that a high frequency quartz oscillator having a frequency of 1 MHz or more provides a temperature and aging stability which is better than that of a low frequency quartz oscillator operating at the usual frequency of 32 kHz. On the other hand the high frequency oscillator having a frequency divider coupled thereto will have a current consumption substantially greater thereby requiring more frequent replacements of the battery. Thus the invention mentioned herein above proposes a oscillator having all the advantages of a high frequency oscillator but wherein consumption does not go beyond that normally exhibited by a low frequency oscillator. In order to achieve such result the cited publication suggests the use of an electronic switch which energized the high frequency oscillator periodically (every 15 minutes) during a relatively short time period (16 seconds). The signals provided by the high frequency and low frequency oscillators fed respectively secondary frequency dividers which each produced at their output a signal of which the period had a value of around 16 seconds. These two signals fed a beat frequency generator of which the resultant output corresponded to the spread between the low frequency period to be controlled and the high frequency reference period. This spread or variant was then used in order to correct the rate of division of the principal frequency divider. Thus, in this system, every 15 minutes the rate of division of the principal divider was questioned or interrogated and, in the case where the frequency of the low frequency oscillator had varied, the rate of division was corrected by a signal provided by a learning circuit formed by a beat frequency generator.

Such system for which the basis of its function has just been described has several disadvantages. Initially several secondary frequency dividers are required thereby complicating construction and manufacture. Additionally it is necessary to transform the signals coming from the high and the low frequency oscillators in order to produce the beat frequency instead of using such signals directly such as they exist in the binary form thereby the result being to diminish the precision. Finally no consideration has been taken in the fact that for reason of the manufacturing price the high frequency quartz may be coarsely adjusted about the nominal frequency range in which case means must be provided in order to memorize the existing variant or spread.

In order to avoid the above-mentioned disadvantages the present invention proposes to regulate the running of the timepiece of the invention by utilizing a low frequency oscillator serving as a time base and arranged to feed a first frequency divider having an adjustable division rate in order to display time. The timepiece further includes a high frequency oscillator arranged to feed a second chain of frequency dividers, with a slave logic circuit being connected between the first and second chains of frequency dividers. The slave logic circuit periodically activates and deactivates the second chain of frequency dividers in response to particular counted pulses from the first chain. Thus, the second chain provides a binary count of the number of reference pulses counted by the second chain of frequency dividers during a period established by the first chain of frequency dividers. This binary count of the second chain is representative of a running variation of the first chain relative to a reference. A first memory means is arranged to receive and store the binary count of the second chain. This binary count in the first memory is then used to correct the division rate of the first chain by use of an inhibition circuit associated with the first chain.

In the preferred embodiment, the binary count of the second chain which is stored in the first memory is compared with a standard value stored in a second memory before using this count for correcting the division rate of the first chain. In this respect, the high frequency oscillator provides a signal having a real frequency coarsely adjusted to approximate a nominal value, while the standard value stored in the second memory represents the binary value of the spread between the real frequency and the nominal value.

DETAILED DESCRIPTION OF THE INVENTION

Figure 1:
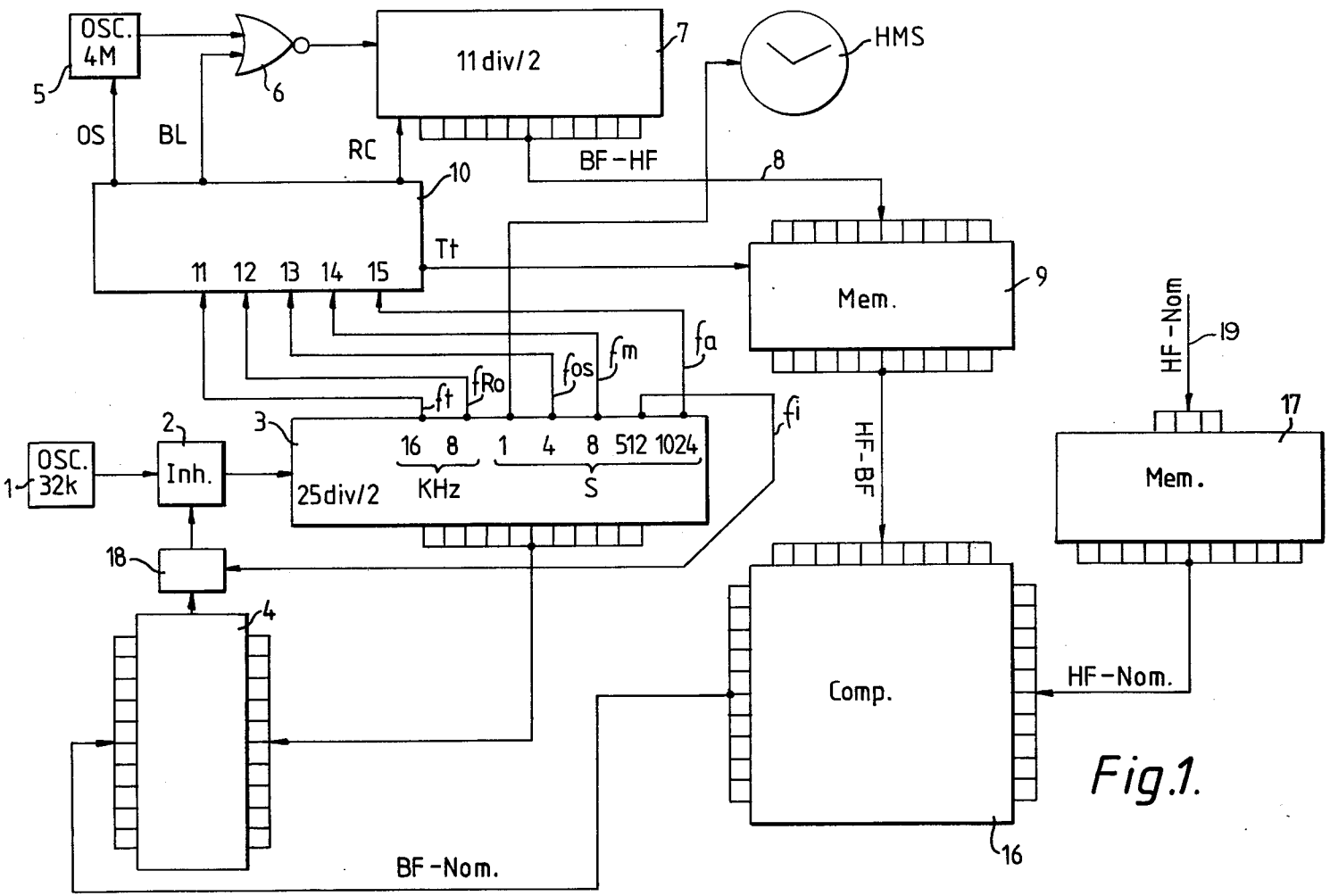
FIG. 1 is a schematic of the principle of the system of the timepiece according to the invention.

FIG. 1 shows how the timepiece according to the invention is arranged. It includes a low frequency oscillator generally comprising a quartz crystal 1 which is coupled through an inhibition circuit 2 to a chain of frequency dividers 3. The inhibition circuit and divider chain together form a system having an adjustable rate. In known timepieces wherein low frequency oscillator has a frequency on the order of 33 kHz fifteen divider stages will be necessary in order to obtain at the output of the display control (1 s) a frequency of 1 Hz in order to display the time of day (HMS). In the present case the divider chain 3 is extended by ten supplementary dividers in order to furnish supplementary outputs at 4, 8, 512 and 1024 seconds. Thus in the example as shown chain 3 comprises twenty-five binary divider stages. At the input of chain 3 the inhibition circuit 2 is controlled by blocks 4 and 18 which enable suppression of a certain proportion of the pulses provided by the time base and thus to lower the control frequency of the motor which drives the display until this is at a desired value.

This technique is already known: it has been sufficiently explained for instance in the Swiss Pat. Nos. 534 913, 554 015 (British patent specification No. 1,392,524, dated Apr. 30, 1975 corresponds to this) and 570 651 so that it should be unnecessary to go greatly into details at present. It will however be recalled that adjustment by feed-back onto an inhibition circuit or onto the frequency divider no longer requires a mechanical adjustment of the time base and the stability of the assembly is no longer affected since one may dispense with a regulating trimmer.

FIG. 1 further shows that the arrangement includes in addition to the low frequency oscillator 1 a second high frequency oscillator 5 again usually given by a quartz crystal which via a NOR gate 6 feeds a second divider chain 7. In the example shown this second chain includes eleven binary dividers and the high frequency oscillator is provided with a quartz with a frequency of 4 MHz. The figure further shows that the high frequency oscillator may be turned on or off periodically via the line OS, that the NOR gate 6 receives at its second input a signal BL capable of blocking or enabling chain 7 and that said chain may be reset to zero via a line RC. The binary word obtained at the output of chain 7 is comprised, in the chosen example, of eleven bits which may be transferred via line 8 into a first memory 9 whenever the transfer command Tt is given to said memory 9.

Signals OS, BL, RC and Tt are provided by the logic control of a slave circuit 10 itself controlled by signals 11 to 15 provided from the divider chain 3. As will subsequently be apparent the binary contents of memory 9 will be employed during the normal running of the timepiece in order to adjust the division rate of the divider chain 3 either directly or indirectly via a comparator circuit 16 which is arranged to compare the contents of the first memory 9 with the contents of a second memory 17.

With the objective of improving the precision of the timepiece without increasing energy consumption, the invention proposes a system where the frequency controlled by the low frequency quartz is periodically slaved to a frequency controlled by a high frequency quartz which has a greater temperature stability. Means are employed so that outside the enslavement periods the high frequency circuits are disconnected.

In Swiss Pat. No. 570 651 already mentioned above the pulses of the frequency to be corrected are counted during a standard period established externally. In the present case it is desired that the standard signal be within the timepiece and one may thus envisage the replacement of the external standard by an internal standard provided by a high frequency quartz. However, since the precision of adjustment is proportional to the number of pulses counted during the standard period for the adjustment of a low frequency, it would thus follow that operation of the high frequency oscillator and the corresponding divider chain would be much too long and would have as consequence an exagerated current consumption for the adjustment precision under consideration. For example should it be desired to detect the frequency variation of 0.06 ppm or $1/2^{24}$ (this permitting a running precision of $31.1 \cdot 10^6$ seconds/year $\times 0.06 \cdot 10^{-6} = 1.86$ seconds/year) it will be necessary to count $2^{24}$ reference pulses. Now if this should be the number of the vibrations of the low frequency oscillator (32 kHz $= 2^{15}$) which is measured during the reference period determined by the high frequency oscillator, the duration of measurement will be $2^{24}/2^{15} = 512$ seconds. If it is admitted on the other hand that the current consumption of the high frequency oscillator plus that of its divider chain is on the order of 15 $\mu$A (the oscillator alone 5 $\mu$A) and that one may neglect in this case the consumption due to the start up time of the oscillator (about 2 s) the increase in the average consumption brought about only by the measuring system and for a slave period of 1024 s will be $$\frac{15\ \mu A}{1024\ s}\ 512\ s = 7.5\ \mu A$$

this being incompatible with a reasonable duration of the battery life.

According to the invention and in order to reduce the operating time of the high frequency circuits the period determined by the low frequency to be corrected is measured by means of the reference pulses generated by the quartz high frequency oscillator. The variation or spread is measured by counting the number of reference pulses contained within the period to be corrected. In other words, the divider chain on which the measurement is effected is not that for which the value is to be corrected, but the reference measured by means of a false period. In taking up the example given in the preceding paragraph and for the same required precision of 0.06 ppm there will be measured during the false low frequency period a number of reference cycles provided by the high frequency quartz (for example 4 MHz $= 2^{22}$) and the measurement will last $2^{24}/2^{22} = 4$ seconds. In considering the same enslavement period of 1024 s the same consumptions of 5 $\mu$A for the high frequency oscillator alone and of 15 $\mu$A for the high frequency circuits as well as a start up time of 2 s for the oscillator, the increase in average consumption brought about by the measuring system will be reduced to $$\frac{15\ \mu A}{1024\ s}\ 4\ s + \frac{5\ \mu A}{1024\ s}\ 2\ s = 0.068\ \mu A$$

which is perfectly acceptable. Effectively the theoretical gain in consumption efficiency is found to be in the ratio of the frequencies employed that is to say f(HF)/f(BF) here equal to $4 \cdot 10^6/32 \cdot 10^4 = 128$, whereas the actual improvement is only on the order of $7.5/0.068 = 110$ since one must take into account the high frequency oscillator consumption during its start up time.

As has been seen, the system of this invention requires a low frequency oscillator which forms the time base employed for the time display of which it is required to correct the lack of precision and a high frequency oscillator which serves as a reference to bring about this correction. Each of these oscillators is followed by a divider chain and one considers here a purely digital correction system. If X (in ppm) designates the total frequency spread presented by the low frequency oscillator and Y (in ppm) the desired precision, the number of regulating steps which are necessary $N_1$ will be $N_1 = X/Y$. The number of bits necessary to bring about these steps will be $d_1=\log_2 N_1$, $d_1$ giving the number of divider stages of the high frequency chain. As far as the adjustment period is concerned the number of steps $N_2$ to be considered in order that a step will have Y ppm will be $N_2=1/Y$ and the number of necessary bits representing the number of divider stages of the low frequency chain will be $d_2=\log_2 N_2$. Finally should one designate by f(BF) minimum the lowest frequency which the low frequency oscillator may present the total regulating or inhibition period in seconds will last $2^{d2}/f(BF)$ minimum. An application to a concrete example of the relationships which has just been given will be shown further on in the description.

Figure 2:
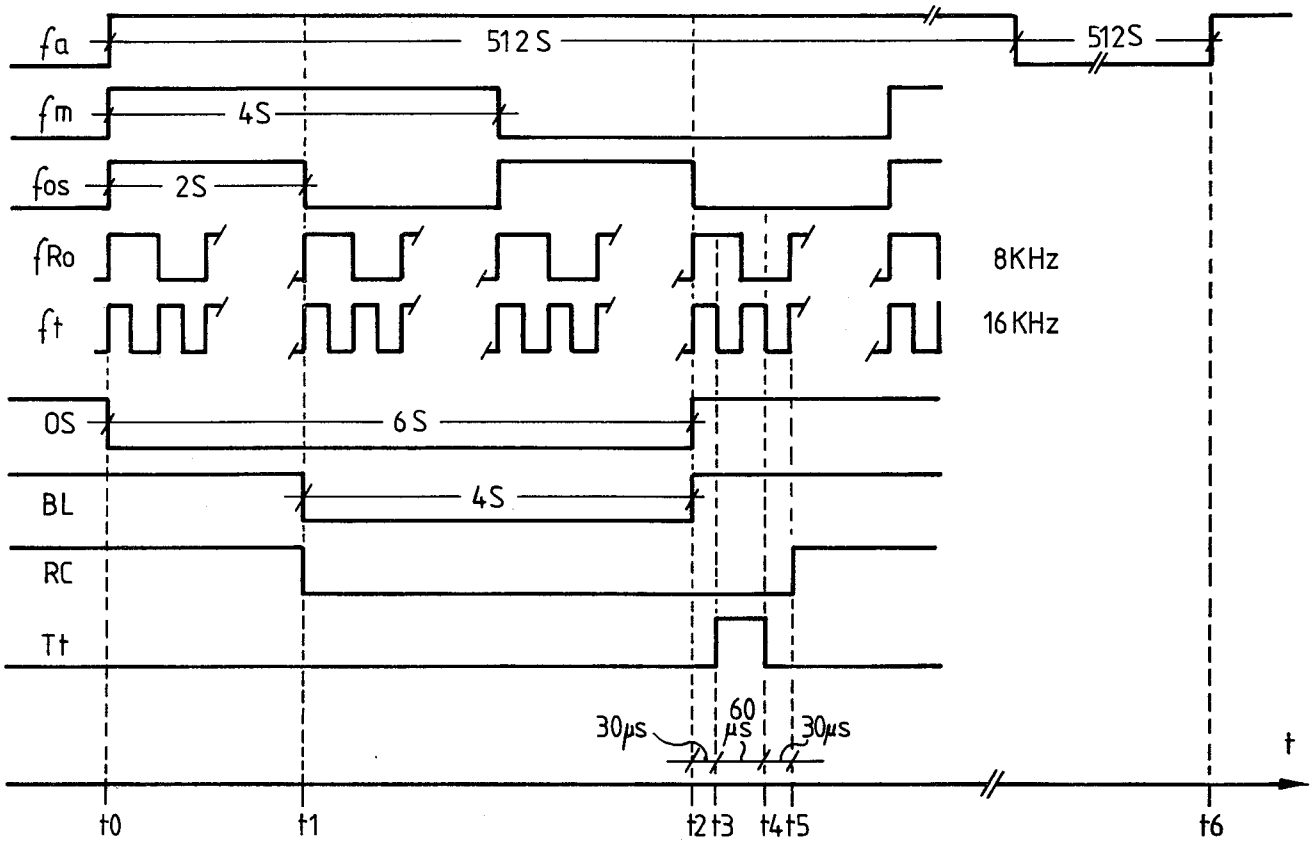
FIG. 2 is a diagram concerning the functioning of the logic control of the slave circuit appearing in FIG. 1.

Reference is now made to the diagram of FIG. 2 which explains the operation of the system. Chain 3 provides at the output of its last divider stage a slave signal fa which is emitted for example every seventeen minutes (1024 s). Each slave cycle fa begins by a measurement cycle fm which is divided into five successive phases (see lines corresponding to the times t of the diagram):

(1) At time $t_0$, the high frequency oscillator starts (signal OS) during a period $t_1-t_0$ sufficiently long to enable its stabilisation (2 s).

(2) At time $t_1$, the high frequency divider chain is enabled (signal BL) at the same time as the normally present reset signal to zero (signal RC) is suppressed. From this instant $t_1$ the measurement is carried out by counting the number of reference pulses furnished by the high frequency chain and this during a predetermined period $t_2-t_1$ furnished by the low frequency divider (4 s).

(3) At the end of said predetermined period, at time $t_2$, the high frequency dividers are blocked (signal BL) and the high frequency oscillator is stopped (signal OS).

(4) Following a short time laps of duration $t_3-t_2$ (30 μs) which takes into account the propagation time of the blocking effect the contents of the high frequency dividers are transferred at time $t_3$ into the first memory 9 (signal Tt) during the period $t_4-t_3$ (60 μs).

(5) Finally following a short security period of duration $t_5-t_4$ (30 μs) the high frequency chain is reset to zero at the time $t_5$ (signal RC).

The same measuring cycle will recommence at time $t_6$ when the duration $t_6-t_0$ (1024 s) is found to represent the enslavement cycle.

The values given is seconds herein above in parentheses are a non limiting example in respect of the scope of the invention for which other values could well be chosen without departing from the object thereof. The same comment is valid for certain values which will be given hereinafter.

As shown in FIG. 1, signals OS, RC, BL and Tt are obtained from the control logic of the slave circuit 10 and are the result of the combination of signals fa, fm, fos, fRo and ft provided from the low frequency chain 3. These latters are shown at the top of the diagram of FIG. 2.

Figure 3:
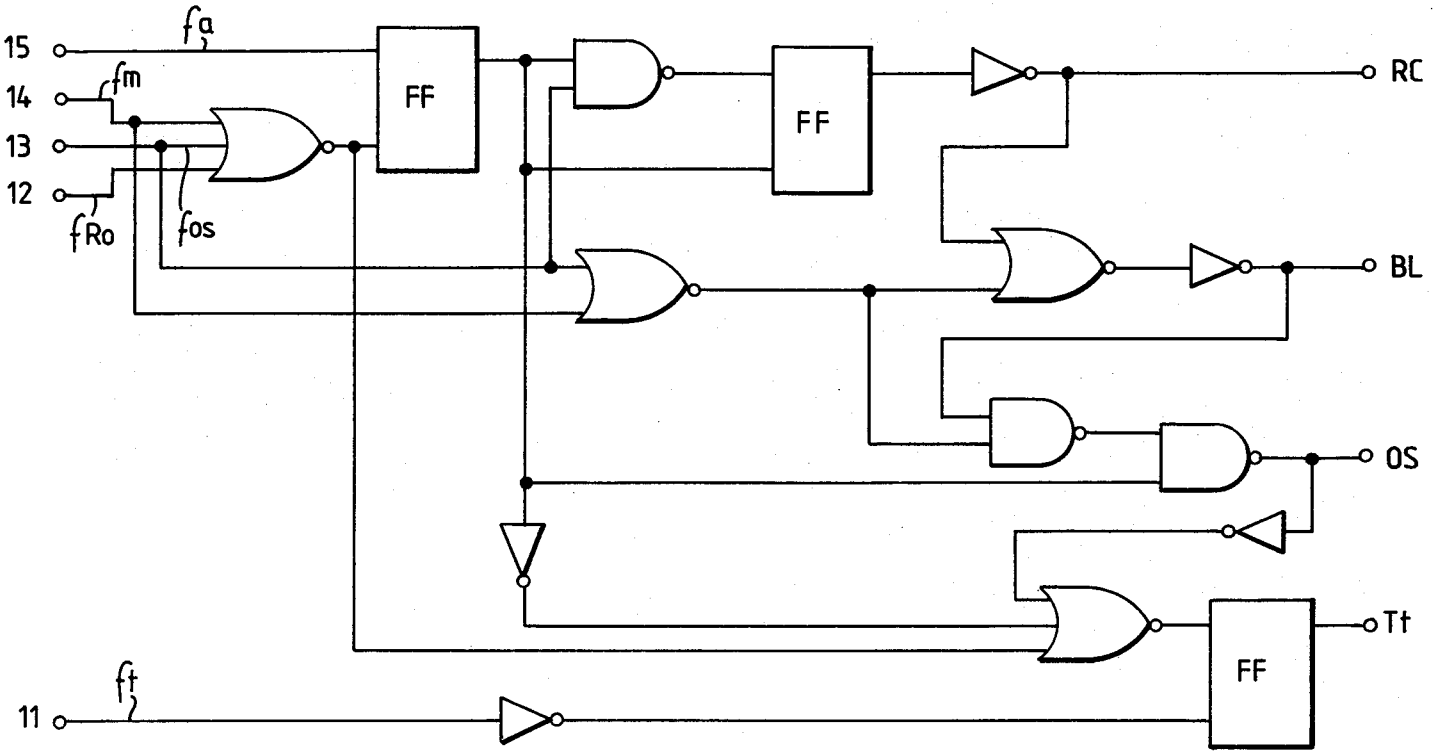
FIG. 3 is a detailed schematic of the slave command circuit such as it appears in the block 10 of FIG. 1.

FIG. 3 shows a possible arrangement for the realization of this combination. The schematic as shown comprises elementary logic circuits: inverters, NOR and NAND gates and flip-flops which form the contents of block 10 shown in FIG. 1. Therein will be found the signals fa, fm, fos, fRo and ft applied to inputs 15, 14, 13, 12 and 11 respectively. The person skilled in the art will understand without the necessity of detailed explanations how the arrangement of the logic circuits is brought about in order to arrive at the signals RC, BL, OS and Tt shown at the output of the block. In addition to the cycles fa and fm mentioned herein above there will be found the signal fos (4 s) which represents the start up signal of the high frequency oscillator and the frequencies fRo (8 kHz) and ft (16 kHz) which assure the transfer time (60 μs) and the security time (30 μs).

It will be understood that it is necessary during the reference pulse measurement to prevent any inhibition. In order to affect this the inhibition period is determined by the signal fi of which the cyclic ratio is 1 coming from the chain 3 and acting on the inhibition control 18 as shown in FIG. 1. The inhibition is brought about when this signal is at the state 0 which is the case only during a half period. At the beginning of the other half period during which no other inhibition takes place, there will periodically correspond the beginning of a slave period fa which is also the beginning of a measurement. This coincidence is automatic owing to the fact that the inhibition signal fi is generated by the same divider chain 3 which generates as well the slave signal fa.

In order to illustrate what has just been said a practical case will now be considered. A low frequency quartz for which the minimum frequency is $2^{15}=32'768$ Hz will be employed. To this is added the usual tolerances as for instance related to the precision of the machine, the aging and the drift due to the temperature which totalize in the case under consideration 115 ppm. Should one seek a precision of 0.06 ppm (which as has been seen above enables a running precision of 1.86 seconds/year) the number of necessary adjustment steps $N_1$ will be $N_1=115/0.06\cong 1900$. In order to obtain these steps the necessary number of bits will be $d_1=\log_2 1900=11$ which is the number of dividers in the high frequency chain. As far as the adjustment period is concerned the number of steps to be considered in order that a step has 0.06 ppm will be $N_2=1/0.06\cdot 10^{-6}=16.6\cdot 10^6$ and the number of dividers of the low frequency chain will be $d_2=\log_2 16.6\cdot 10^6=24$. Finally since the minimum frequency shown by the low frequency oscillator is $2^{15}$ Hz the total inhibition period will last $2^{24}/2^{15}=512$ seconds. To the twenty-four dividers of the chain 3 which are necessary in order that the system may function (the signal emitted by the twenty-fourth acting on the inhibition control 18) will be added a twenty-fifth (1024 s) which every seventeen minutes will recommence the slave cycle.

Figure 4:
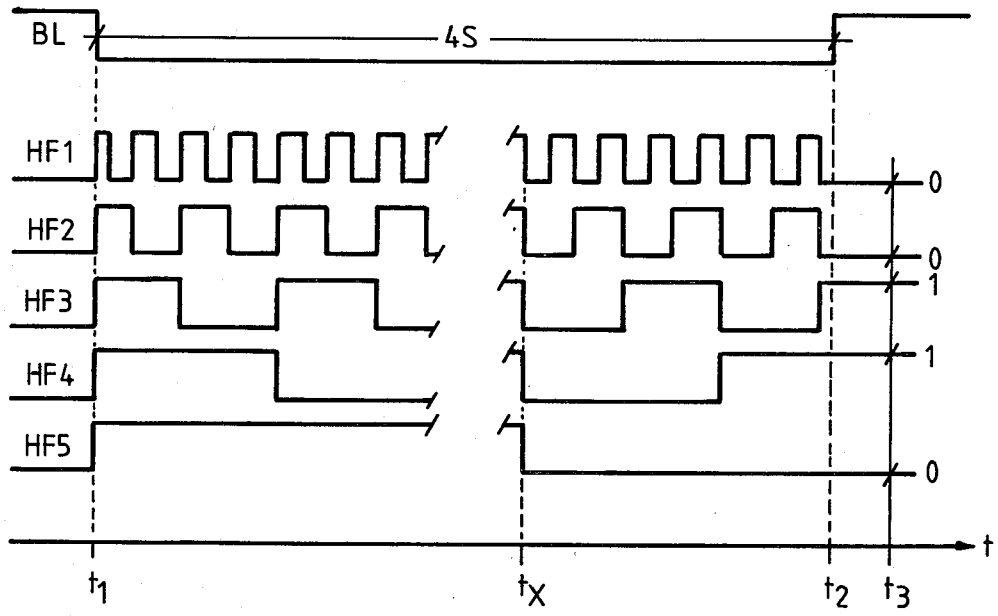
FIG. 4 is a timing diagram showing the behaviour of the high frequency divider chain during a low frequency regulation period.

Diagram of FIG. 4 shows what occurs during the period to be corrected. This period determined by the low frequency chain commences at time $t_1$ as soon as the signal BL passes to the 0 state and stops at time $t_2$ as soon as said signal returns to the 1 state. From the moment $t_1$ the high frequency chain begins to count the pulses emitted by the high frequency oscillator. In FIG. 4 are represented signals ($HF_1$ to $HF_5$) present at the output of five successive dividers of the high frequency chain (which normally includes eleven in the example cited here). In order to make more explicit this drawing it will be understood that it has been necessary to choose another time scale in order to represent in superposition the low frequency period (4 s) and the high frequency pulses of which the lowest frequency following eleven divisions is still 4 kHz. At a certain moment (time $t_x$) all high frequency dividers will be set to 0 and this before the period to be corrected BL is terminated. This is due to the fact that a high frequency quartz has been chosen with wider tolerance ranges (for instance +140 to +4140 ppm) than the tolerances of the low frequency quartz (for instance +60 to +100 ppm). Following the instant to time $t_x$ the high frequency chain will recommence a counting cycle which will be interrupt at time $t_2$. At this instant the logic state of all the high frequency dividers is a measure of the spread separating the moment $t_x$ where all high frequency dividers have been reset to 0 and that at which terminates the period to be corrected ($t_2$). In the figure, the five dividers represented show the binary value 00110 at the moment of stopping of the counting of this chain. This value is momentarily retained by the chain 7 before being transferred via line 8 following time $t_3$ into the first memory 9 as shown also on FIG. 2.

One now has available at the output of memory 9 a binary value corresponding to the spread between the low frequency period (BF) to be corrected and the high frequency reference period (HF). This spread value will be denominated HF−BF.

Theoretically it can be imagined that the high frequency oscillator will provide an exact nominal frequency. In such case the spread HF−BF could be profitably employed in acting directly on the inhibition control circuit 4 such as has been proposed by the Swiss patents cited herein above.

In reality whatever be the means employed to adjust the high frequency quartz as close as possible to its nominal frequency there will always exist a difference between this nominal value and the real value. Furthermore in order to simplify the manufacturing operations one may even employ high frequency quartz which are very coarsely adjusted. In such case there may be grouped by categories. For each such category the spread is measured between the real value produced by the second divider and the nominal value which said second divider should produce if it were fed by a signal having the nominal frequency. This difference or standard value which one may call variation or spread HF−Nom. is introduced once and for all via line 19 into a second memory 17 (which may be a non volatile memory if one would wish to conserve its information during battery change). It should be arranged in order that the output of memory 17 provides a binary value which should be expressed in bits having identical weight to those coming from the first memory 9. It is from that point possible to compare the spread HF−BF with the spread HF−Nom. in a subtraction circuit 16 in a manner to obtain a binary signal at the output of the subtractor which represents the spread BF−Nom. in order to act on the inhibition control 4.

It is thus possible to arrive at a precise regulation of the running of the timepiece. This regulation is carried out periodically and automatically thanks to means which are contained within the timepiece. No external intervention is necessary except naturally that which consists at the time of manufacture of the watch to memorize once and for all the spread existing between the high frequency quartz as chosen and the nominal frequency which should to obtained from this quartz.

Figure 5:
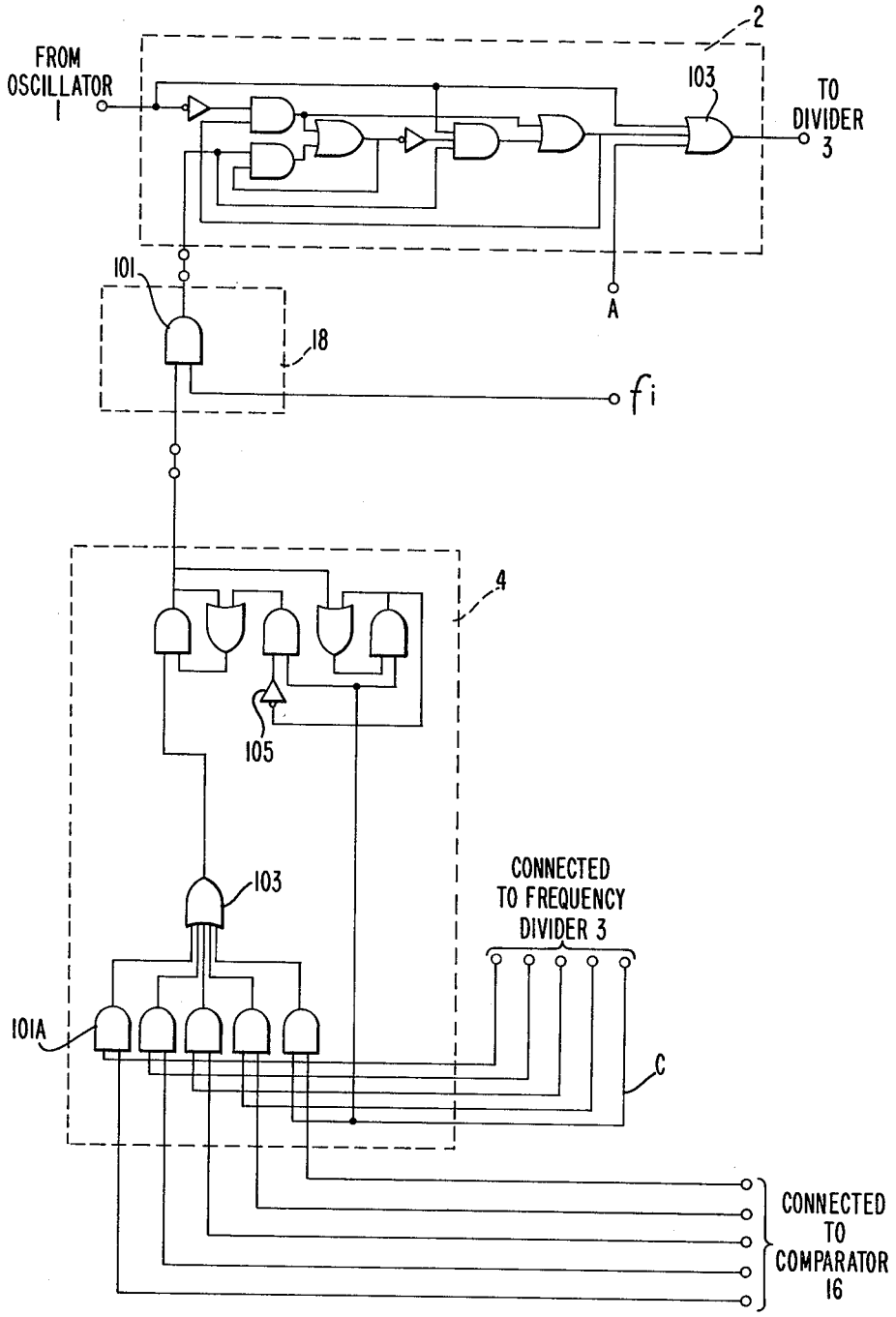
Fig. 5 PRIOR ART
FIG. 5 is a block diagram showing an inhibition circuit described in British Pat. No. 1,392,524, published Apr. 30, 1975, which can be used in this invention.

As is mentioned above, British patent specification No. 1,392,524, dated Apr. 30, 1975 discloses an inhibition circuit which can be used in this invention. For the purpose of completeness, this inhibition circuit is depicted in block diagram form in FIG. 5 herein, with normal symbols being used for AND gates 101 and OR gates 103. Symbols 105 are reversers (throw-over switches). Those portions of the circuit of FIG. 5 corresponding to elements 2, 4 and 18 of FIG. 1 are blocked off with dashed lines and are appropriately numbered as are connections to the oscillator 1, the frequency dividers 3 and the comparator 16. Fewer connections between the element 4 and the frequency divider 3 and the comparator 16 are actually depicted in FIG. 5 than are needed for most cases of the circuit of FIG. 1, for simplicity sake. The input A provides thermal compensation and is, therefore, not important in understanding this invention. The signal fi of FIG. 1 is shown being fed to block 18 in FIG. 5. Terminal C receives the longest pulse fed to the circuit 4 from the frequency divider 3. Again, all of this is disclosed in British specification No. 1,392,524 and any deviation from that disclosure is not intended. For further information concerning this particular disclosure material one should consult the British specification.

It will be noted that the system as described is applicable to any type of oscillator. In cases where the drift of the low frequency oscillator should be greater than that given by a quartz (here 115 ppm) it would be sufficient to increase the number of dividers in the high frequency chain. In the state of the technology however it is difficult to foresee a high frequency oscillator other than that of which the reference frequency would be given by a quartz.

What I claim is:

1. Timepiece including a low frequency oscillator serving as a time base and arranged to feed a first chain of frequency dividers having an adjustable division rate in order to display the time and a high frequency oscillator arranged to feed a second chain of frequency dividers, slave means coupled between said first and second frequency dividers and arranged and adapted to be operated periodically in order to obtain a binary count of the number of reference pulses counted by the second chain of frequency dividers during a predetermined time period established by the first chain of frequency dividers thereby to determine a binary value representative of the running variation of the first chain relative to the reference, first memory means coupled to said second chain of frequency dividers to receive and store said binary value and means responsve to said binary value coupled between said first memory means and said first chain of frequency dividers for correcting the division rate of said first chain during normal running of said timepiece.

2. Timepiece as set forth in claim 1 comprising an inhibition circuit associated with the first chain of frequency dividers and arranged to respond to said binary value thereby to adjust the division rate of said first chain.

3. Timepiece as set forth in claim 1 wherein said slave means comprises a logic control circuit the inputs of which are coupled to predetermined outputs of the first chain of frequency dividers chosen so as to assure in an established order the starting or stopping of the high frequency oscillator, the inhibiting or enabling of the second chain of frequency dividers, the reset to zero of said second chain and the transfer of said binary value into said first memory means.

4. Timepiece as set forth in claim 3 wherein said slave means is arranged and adapted to run through a cycle extending from a time $t_0$ to a time $t_6$ during which at time $t_0$ all divider elements of the first chain are in the zero state and the high frequency oscillator is started, at time $t_1$ the second chain of dividers functions thereby to count the reference pulses supplied by the high frequency oscillator during a period $t_2-t_1$ predetermined by the first chain, at time $t_2$ the second chain is blocked and the high frequency oscillator is stopped, at time $t_3$ the contents of the second chain is transferred into said first memory means during the period $t_4-t_3$, at time $t_5$ the second chain is rest to zero and at time $t_6$ the cycle recommences.

5. A timepiece as set forth in claim 1 wherein said high frequency oscillator provides a signal having a real frequency coarsely adjusted to approximate a nominal value; and wherein said means responsive to said binary value includes a subtractor circuit coupled to a second memory means said subtractor circuit receiving said binary count from said first memory and subtracting said binary count from a standard value stored in said second memory means, said standard value being the binary value respresentative of the spread between said real frequency and said nominal frequency, the binary count issuing from said subtractor circuit being coupled to said first chain and acting on the first chain thereby to adjust the division rate of said first chain.

* * * * *